US005499476A

United States Patent [19]

Adams et al.

[11] Patent Number: 5,499,476

[45] Date of Patent: Mar. 19, 1996

[54] LOW PROFILE RAISED PANEL FLOORING WITH METAL SUPPORT STRUCTURE

[75] Inventors: Harold F. Adams, LaGrange; Roderick A. Suarez, Forest Park; Lewis H. Engle, Peachtree City, all of Ga.

[73] Assignee: Interface, Inc., La Grange, Ga.

[21] Appl. No.: 114,447

[22] Filed: Aug. 31, 1993

[51] Int. Cl.[6] ..... E04B 5/43

[52] U.S. Cl. ..... 52/220.1; 52/220.2; 52/236.3; 52/236.6; 52/510; 248/300; 248/357; 248/248

[58] Field of Search ..... 52/220.1, 220.2, 52/236.3, 236.6, 263, 510; 248/300, 357, 248

[56] References Cited

U.S. PATENT DOCUMENTS

| | | |
|---|---|---|
| 1,861,359 | 5/1932 | Pyron . |
| 2,089,893 | 8/1937 | Greulich . |
| 2,680,775 | 6/1954 | Wiesmann . |
| 2,830,332 | 4/1958 | Pawlowski . |
| 2,867,301 | 1/1959 | Benton . |
| 2,956,785 | 10/1960 | Riehl . |
| 3,025,934 | 3/1962 | Spiselman et al. . |

(List continued on next page.)

FOREIGN PATENT DOCUMENTS

| | | |
|---|---|---|
| 0218108 | 9/1986 | European Pat. Off. . |

(List continued on next page.)

OTHER PUBLICATIONS

Cat. No. NF873E, "For Modern Offices, Network Floor (Flexible Floor Cabling System)," Brochure, Kyoda Electric Co., Ltd., Tokyo, Japan (Mar. 1987).

"Installationsboden, zur flexiblen Kabelverlegung unter Bodenbelagen—bevorzugt unter Teppichfliesen—mit flachendeckendem Zugang fur Kabelsustritte in beliebiger Menge," (pub. after Mar. 10, 1989, see date on picture).

"Access Floor," Brochure, The Hiross Group.

I.G. C328F "High Class Access Floors," Brochure, The Hiross Group (Feb. 1991).

"Today," Brochure, The Hiross Group.

"Planning Tile & Floor," vol. 2, Brochure, Kokuvo.

10270/CTE, Buyline 2971, Form 9/92–19M, "Access Flooring Systems," Brochure, C–TEC, Inc. (1992).

SA–1027/1–91, "Access Floor Systems," Brochure, USG Interiors, Inc. (1991).

10270/HIT, Buyline 1976, "Hitachi Access Floor," Brochure, Hitachi Metals America, Ltd. (Oct. 1992).

6574/10270/MUL, "Mult–A–Frame," Brochure, Mult–A–Frame, Inc. (1992).

"Access Floors Designated for Today's Business Environments," Brochure, Tate Access Floors, Inc. (Sep. 1988).

10270/COD, Buyline 4657, "Co Design, Cablefloor, Non–Metallic, Low Profile Access Floor System," Brochure, Co Design, Inc.

"Raised Flooring System H 16," Brochure, Herforder Teppichfabrik Huchzermeyer & Co. GmbH (1989).

"Powerfloor Quick–Connect Wire Management," Brochure, Powerflor, Inc.

*Primary Examiner*—Carl D. Friedman
*Assistant Examiner*—Christopher Todd Kent
*Attorney, Agent, or Firm*—Dean W. Russell; Kilpatrick & Cody

[57] ABSTRACT

A raised flooring system and methods of forming components of such a system are disclosed. Systems consistent with embodiments of the present invention utilize thin sheet metal, typically galvanized steel, base plates laid side by side on an existing floor. Attached in a rectilinear pattern to the base plates are stand-offs, which support floor panels forming the raised or false floor (which in turn are typically covered with carpet tile). In addition to supporting the floor panels, the stand-offs form a network of channels where conduit, cables, hoses, pipe and similar materials can be routed. The stand-offs are punched and then formed from thin sheet metal, also typically galvanized steel, and have an overall shape generally that of a truncated cone achieved with four arms that have rolled edges for enhanced load-bearing capacity.

14 Claims, 3 Drawing Sheets

U.S. PATENT DOCUMENTS

| | | | |
|---|---|---|---|
| 3,218,767 | 11/1965 | Stark . | |
| 3,295,272 | 1/1967 | Kanno . | |
| 3,387,422 | 6/1968 | Wanzer . | |
| 3,645,054 | 2/1972 | Olvera . | |
| 3,815,304 | 6/1974 | Schille et al. . | |
| 3,852,928 | 12/1974 | Raith . | |
| 3,894,370 | 7/1975 | Parazader . | |
| 4,016,357 | 4/1977 | Abrahamsen . | |
| 4,026,083 | 5/1977 | Hoyt et al. . | |
| 4,035,967 | 7/1977 | Harvey . | |
| 4,074,488 | 2/1978 | Ray, III . | |
| 4,085,557 | 4/1978 | Tharp . | |
| 4,124,324 | 11/1978 | Augis et al. . | |
| 4,546,580 | 10/1985 | Ueno et al. . | |
| 4,558,544 | 12/1985 | Albrecht et al. . | |
| 4,573,302 | 3/1986 | Caretto . | |
| 4,593,499 | 6/1986 | Kobayashi et al. . | |
| 4,596,095 | 6/1986 | Chalfant . | |
| 4,648,592 | 3/1987 | Harnishi . | |
| 4,662,140 | 5/1987 | Porter et al. . | |
| 4,682,453 | 7/1987 | Holmgren . | |
| 4,744,194 | 5/1988 | Yasuyoshi . | |
| 4,761,926 | 8/1988 | Rea et al. . | |
| 4,773,196 | 9/1988 | Yoshida et al. . | |
| 4,780,571 | 10/1988 | Huang . | |
| 4,858,401 | 8/1989 | Thorp et al. . | |
| 4,883,503 | 11/1989 | Fish . | |
| 4,905,437 | 3/1990 | Heather . | |
| 4,923,733 | 5/1990 | Herbst . | |
| 4,968,855 | 11/1990 | Le Paillier . | |
| 4,993,202 | 2/1991 | Theil . | |
| 4,996,810 | 3/1991 | Forde . | |
| 5,042,569 | 8/1991 | Siegmund . | |
| 5,052,157 | 10/1991 | Ducroux et al. | 52/263 |
| 5,057,647 | 10/1991 | Bogden et al. . | |
| 5,072,557 | 12/1991 | Naka et al. | 52/263 |
| 5,074,085 | 12/1991 | Ueda . | |
| 5,082,712 | 1/1992 | Starp . | |
| 5,090,169 | 2/1992 | Takeda et al. . | |
| 5,105,595 | 4/1992 | Tokei et al. . | |
| 5,184,438 | 2/1993 | Takeda et al. . | |
| 5,187,907 | 2/1993 | Takeda et al. . | |
| 5,197,244 | 3/1993 | Takeda et al. . | |
| 5,245,805 | 9/1993 | Takeda et al. . | |
| 5,263,289 | 11/1993 | Boyd . | |

FOREIGN PATENT DOCUMENTS

| | | |
|---|---|---|
| 0197957 | 4/1988 | European Pat. Off. . |
| 352435 | 5/1989 | European Pat. Off. . |
| 1133496 | 3/1957 | France . |
| 1307901 | 9/1962 | France . |
| 1547666 | 10/1967 | France . |
| 1601001 | 9/1970 | France . |
| 2041599 | 1/1971 | France . |
| 2483990 | 12/1981 | France . |
| 1196345 | 7/1965 | Germany . |
| 1759372 | 6/1971 | Germany . |
| 2102050 | 7/1972 | Germany . |
| 2314463 | 2/1975 | Germany . |
| 2353865 | 5/1975 | Germany . |
| 2650160 | 5/1978 | Germany . |
| 3415581 | 11/1985 | Germany . |
| 8807177 U | 5/1989 | Germany . |
| 3801765 | 7/1989 | Germany . |
| 9106389 U | 5/1991 | Germany . |
| 145018 | 10/1993 | Rep. of Korea . |
| 145017 | 10/1993 | Rep. of Korea . |
| 822738 | 10/1959 | United Kingdom . |
| 876117 | 8/1961 | United Kingdom . |
| 1104490 | 2/1968 | United Kingdom . |
| 1174562 | 12/1969 | United Kingdom . |
| 1425977 | 2/1976 | United Kingdom . |
| 2097836 | 5/1981 | United Kingdom . |
| 2127062 | 4/1984 | United Kingdom . |
| 2188955 | 10/1987 | United Kingdom . |
| 2190936 | 12/1987 | United Kingdom . |
| WO85/05397 | 12/1985 | WIPO . |
| WO87/03324 | 6/1987 | WIPO . |
| WO88/03207 | 5/1988 | WIPO . |

LOW PROFILE RAISED PANEL FLOORING WITH METAL SUPPORT STRUCTURE

BACKGROUND OF THE INVENTION

The present invention relates to flooring systems especially designed for facilities that house data processing equipment such as data processing centers, computer rooms, and offices where there is a false floor raised above the existing floor. Such false floors or raised panel floors typically utilize removable panels laid side-by-side upon raised support members in order to afford a free space where conduit, cables, hoses, wires and other computer interconnections can be routed. Many false flooring systems exist, including ones that use adjustable jacks at each panel corner as a means of support. The support jacks for such systems are only located at the corners of the panels, which are usually square with sides of 500 to 600 mm. Accordingly, rigidity and mechanical stability of the floor must be achieved through the use of very thick panels, usually 30 to 40 mm thick, sometimes including a framework which transfers the load to the jacks. Due to the loss of usable height, these types of false flooring require an overall height of 150 to 200 mm, which is incompatible with low ceilings in existing buildings and requires new facilities to be built with added height. As an example, if one considers a 200 mm false floor at each level of a thirty-story building, the additional required height becomes six meters, the equivalent of two stories. Installing such a false floor in existing buildings requires the construction of ramps and steps as well as fire and soundproofing barriers. Finally, such structures are sometimes noisy and act as resonators. In any event, installing existing false floors either as part of a building renovation or in new construction, is both involved and costly.

U.S. Pat. No. 5,052,157 (the "'157 patent"), incorporated herein in its entirety by this reference, describes an excellent "Flooring System Especially Designed for Facilities Which House Data Processing Equipment." The system described in the '157 patent solves many of the problems associated with previous systems, including such problems described above. However, the '157 patent contemplates and illustrates construction of portions of the system "by heat forming or injection molding of a plastic compound such as polystyrene, polyethylene, polypropylene or ABS." While such materials are excellent choices for the formation of the components for which they are suggested in the '157 patent, particularly in view of the complex shapes of some of those components, drawbacks are associated with the use of such materials in certain applications. First, the load-bearing capacity of a raised panel flooring structure utilizing such plastic materials is, in part, a function of the quantity and type of plastic materials utilized, and it can be difficult to achieve high load-bearing capacities with such plastic structures at acceptable costs and without undesirable weight. Additionally, although the nature of the application and the use of flame-retardant and smoke-suppression formulations and additives can make use of such plastic materials acceptably safe as construction materials, some fire codes nevertheless limit or prevent the use of plastic structures as components of raised panel flooring.

Use of metal in structures of raised panel flooring provides a logical alternative, noncombustible material. Indeed, the '157 patent suggests that the one-piece base plate and stand-offs structure described therein could be stamped from sheet metal and that the base plate in the separate base plate and stand-off embodiment of the invention could be thin galvanized sheet steel. The '157 patent does not, however, teach how to form any of the base plate or stand-off components described in it from metal. Moreover, stamping the one-piece base plate and stand-offs structure of the '157 patent from sheet metal is probably impractical because of the distance that metal would have to be drawn in order to form the stand-off structure. Formation of the separate stand-off structure taught by the '157 patent would encounter similar problems, and the patent does not even explicitly suggest the use of metal for that structure but rather teaches that "[t]hese stand-offs can be made of any material, but injection molded ABS would be advantageous." Separate metal stand-offs having the solid-surface, hollow truncated conical structure of the stand-offs taught in the '157 patent would also be difficult to attach to base plates because of the difficulty of deforming the stand-off in order to align or adjust attaching tabs or other members to achieve engagement with the base plate.

Numerous other prior raised panel or false floor systems use metal components, but many such systems also use combustible materials or are expensive, difficult to install, perform poorly, elevate the floor excessively, will not adequately accommodate conduit or other materials that need to pass under the raised floor, or have other drawbacks. Accordingly, there remains a need for a low profile raised panel flooring system using components compatible with the strictest fire codes, that can offer high load-bearing capacity and overcomes other disadvantages of the prior systems.

SUMMARY OF THE INVENTION

In order to provide such an improved system, the present invention utilizes thin sheet metal, typically galvanized steel, base plates laid side by side on the existing floor, on which stand-offs are attached in a rectilinear pattern to serve as supports for floor panels that form the raised or false floor and are typically covered with carpet tile. In addition to supporting the floor panels, the stand-offs form a network of channels where conduit, cables, hoses, pipe and similar materials can be routed.

The stand-offs are punched and then formed from thin sheet metal, also typically galvanized steel, and have an overall shape generally that of a truncated cone achieved with four arms that have rolled edges for enhanced load-bearing capacity. Like the stand-offs described in the '157 patent, the stand-offs of the present invention present a top surface parallel to the base plate for supporting floor panels, with a cruciform groove to receive edges of the floor panels. The cruciform groove divides the support surface into four quadrants, and each quadrant has a screw hole in a conical depression to receive a screw passing through a corner of a floor panel. The conical depression causes the hole to close, enhancing its holding power, as the screw is tightened.

A tab on the end of each arm of each stand-off is received with a friction fit in an opening in the base plate, and is bent to lie against the underside of the base plate in a depression formed therein. The four-arm structure of the stand-offs permits the arms to be bent slightly relative to each other so that alignment between the tabs and tab-receiving openings in the base plate is easily achieved during assembly. Typically, the arms are compressed, or squeezed, inward slightly so that the tabs, which (like the arms from which they extend) flare, can easily enter the openings in the base plate. Spring-back of the stand-off arms combined with the friction fit between the tabs and base plate openings ensure that the stand-offs will not disengage from the base plates before the tabs can be bent during the assembly process.

Score or cutting lines may be formed in the base plate for breaking or to facilitate cutting it during installation. Additionally, electrical continuity between adjacent base plates may be achieved by the inclusion of projecting tabs on a plate that underlie and contact an adjacent plate.

It is therefore an object of the present invention to provide a flooring system at least portions of which are non-combustible.

It is another object of the present invention to provide a flooring system having stand-offs with enhanced load-bearing capability.

It is an additional object of the present invention to provide a flooring system in which the system's load-bearing capability is enhanced through use of stand-offs having multiple metal arms with rolled edges.

It is a further object of the present invention to provide a flooring system in which the stand-offs can be compressed and decompressed as required for improved assembly.

It is yet another object of the present invention to provide a flooring system in which the stand-offs are retained in the base plates by a friction fit.

Other objects, features, and advantages of the present invention will be apparent with reference to the remainder of the text and the drawings of this application.

DETAILED DESCRIPTION

Figure 1:
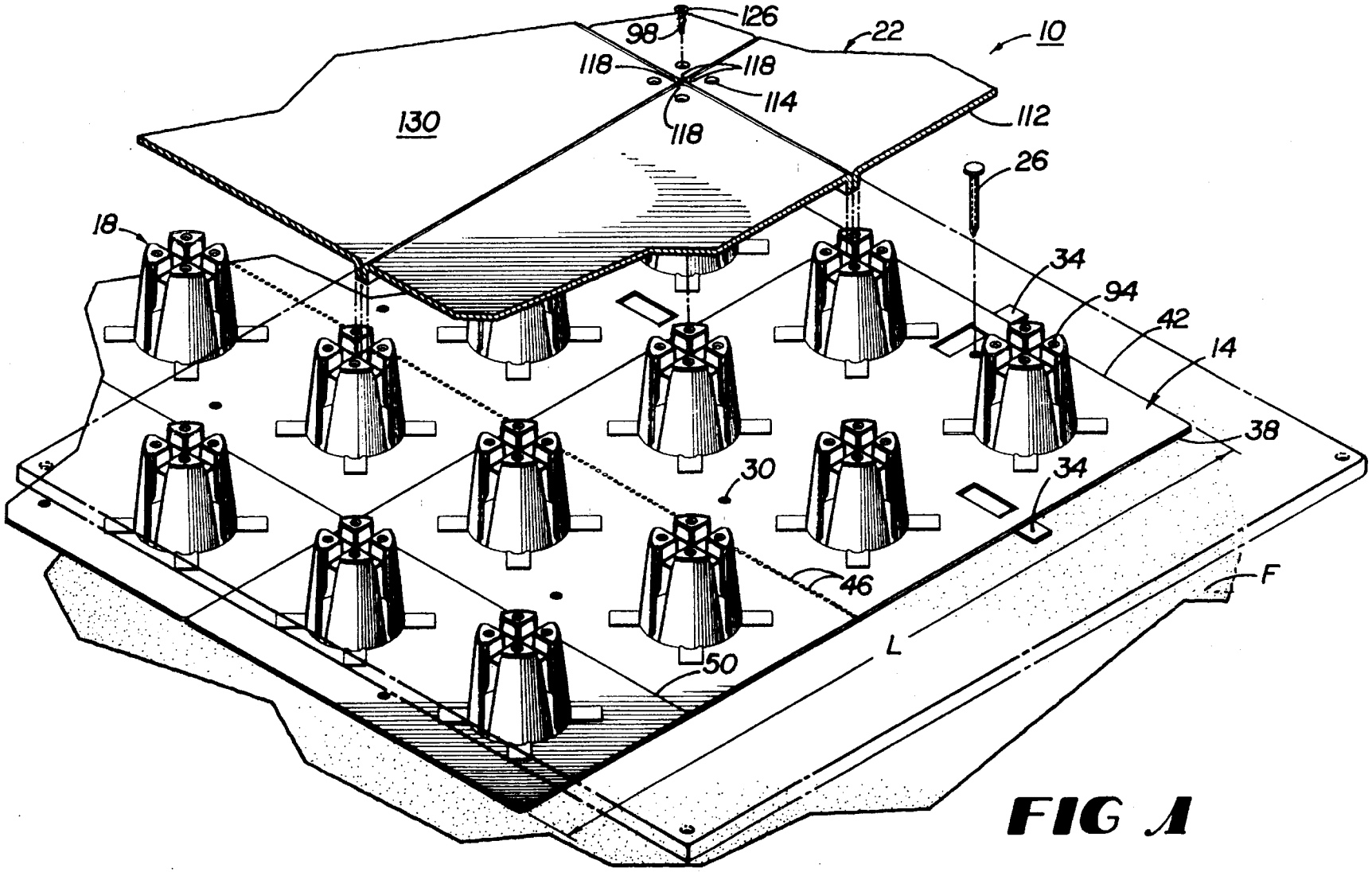
FIG. 1 is an exploded perspective view of a raised panel flooring system of the present invention showing the floor panels exploded away from two assembled base plate and stand-offs units lying on a floor.
Figure 2:
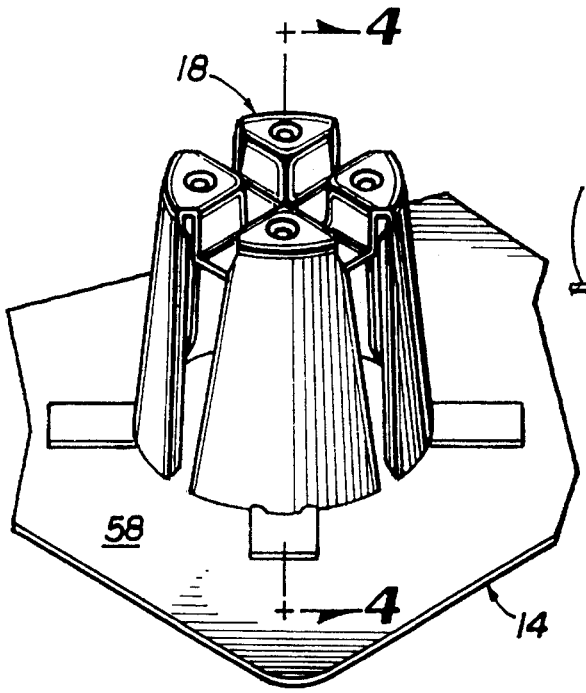
FIG. 2 is a perspective view of a corner of an assembled base plate and stand-off of the present invention.

FIG. 1 illustrates an embodiment of flooring system 10 of the present invention. System 10 generally includes at least one base plate 14, to which stand-offs 18 are attached, and one or more floor panels 22. Stand-offs 18 support floor panels 22 above base plates 14, permitting floor panels 22 to form a false or raised floor under which conduit, cables, or other connectors can be routed.

As shown in FIG. 1, base plates 14 are adapted to be placed on an existing floor F. Fasteners such as nails 26 can be used to penetrate floor F through openings 30 and thereby secure base plates 14 to the floor F. Alternatively, adhesive may be used in some applications to secure base plates 14 to floor F. Such fasteners are not required, however, as base plates 14 and many existing floors F have coefficients of friction sufficient to retain the base plates 14 in position under normal loads. In use, base plates 14 are typically laid side-by-side in a rectilinear pattern throughout the area of existing floor F, further minimizing the possibility that one base plate 14 will shift relative to the others. Laying metal base plates 14 side-by-side also provides electrical conductivity throughout the affected area, enhancing, for example, the available ground plane. To improve the grounding capability of system 10, some embodiments of base plate 14 include metal tabs 34 extending beyond the edges 38 and 42 of the base plate 14 and on which adjacent base plates 14 may be placed.

Although the base plates 14 of FIG. 1 each include eight, uniformly-spaced stand-offs 18, greater or fewer stand-offs 18 may be contained on a base plate 14 and the spacing of stand-offs 18 may be modified as necessary or desired. Base plate 14 may additionally be weakened to facilitate its division into multiple portions. FIG. 1 illustrates perforations 46 bisecting length L of base plate 14, for example, as well as scoring 50 for separating a pair of stand-offs 18 from the remainder of base plate 14. Those skilled in the appropriate art will recognize that base plate 14 can be weakened in other locations and manners, however, to create differing shapes and sizes.

Figure 3:
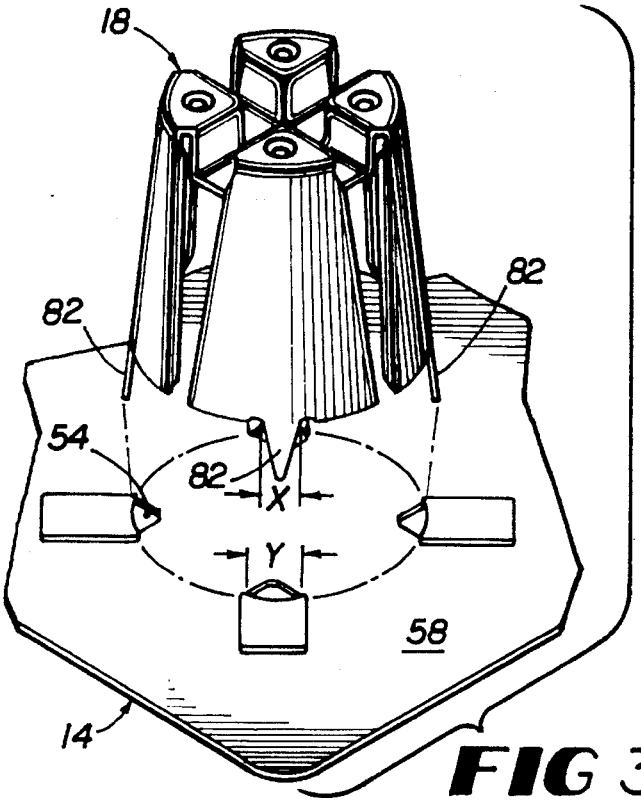
FIG. 3 is an exploded perspective view of the base plate and stand-off of FIG. 2 prior to assembly.
Figure 7:
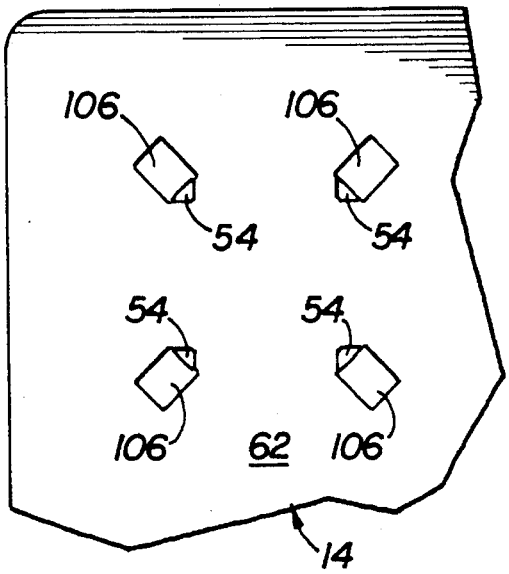
FIG. 7 is a plan view of the base plate of FIG. 2 prior to receiving a stand-off.

Base plate 14 is typically made of metal, such as galvanized steel, and in some embodiments is approximately 0.020" thick. Because it receives stand-offs 18, base plate 14 includes sets of openings 54 into which the stand-offs 18 are fitted. FIGS. 3 and 7 detail these openings 54 as viewed from, respectively, the upper (58) and lower (62) surfaces of base plate 14.

FIGS. 1–5, 5A–6, and 8A–D detail aspects of stand-offs 18. Stand-offs 18 consistent with the present invention can initially be punched from sheet metal, creating the blank 66 shown in FIG. 8A. Although embodiments of blank 66 may be made of galvanized steel approximately 0.030" thick, other materials and materials of other thicknesses may be used as appropriate or desired. Blank 66 nonetheless includes a central section 70 from which corresponding necks 74 and arms 78 extend at approximately 90° intervals. Arms 78, which flare from necks 74, terminate in tabs 82 shaped to be received by openings 54.

Figure 8C:
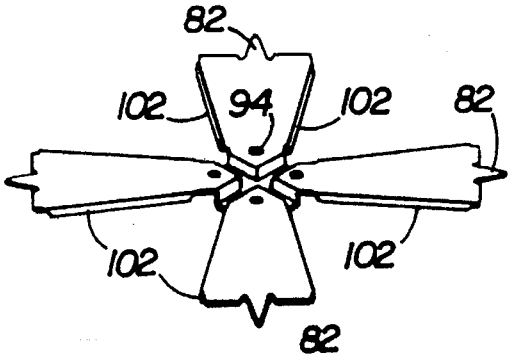
Figure 8D:
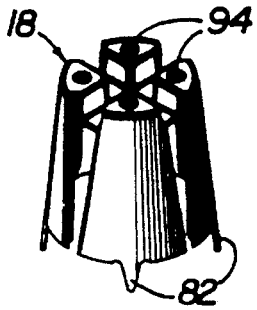

Following formation of blank 66, central section 70 may be drawn (FIG. 8B) to create cruciform groove 86 for receiving complementary portions of floor panels 22. Groove 86 divides necks 74, which support floor panels 22, into four quadrants 90A–D, each having an opening 94 (FIG. 8C) in a conical depression to receive a fastener such as screw 98. The conical depression causes opening 94 to close as screw 98 is tightened, thereby enhancing its ability to hold screw 98 (and floor panel 22) in place. Also as shown in FIG. 8C, edges 102 of arms 78 may be rolled for improved load-bearing capacity. After doing so arms 78 are bent approximately 90° to depend from quadrants 90A–D and curved transverse to their length, with such curvature increasing in radius progressing from quadrants 90A–D to tabs 82, forming stand-off 18 with an overall shape generally that of a truncated cone.

Placement of stand-off 18 in base plate 14 is shown in FIG. 3. As illustrated therein, tabs 82 are aligned with and inserted into openings 54 of base plate 14. Because the maximum width X of each tab 82 is slightly greater than the width Y of the corresponding opening 54, inserting tab 82 into the opening 54 produces a friction fit that helps retain stand-off 18 in place. Once inserted, each tab 82 is bent to lie against the lower surface 62 of base plate 14 in a depression 106 formed in the lower surface 62, permitting tab 82 to lie flush with the lower surface 62 of base plate 14 in use. Alternatively, it may be desirable for depression 106 to be slightly less deep than the thickness of tab 82, with the result that the base plate 14 and stand-offs 18 assemblies of the present invention will actually rest in part on tabs 82, thereby assuring that tabs 82 will be kept firmly in place as a result of loading of the flooring system 10. During assembly arms 78 may additionally be compressed (squeezed) inward slightly so that tabs 82 more easily enter openings 54. Spring-back of arms 78 further assists in retaining stand-off 18 in place relative to base plate 14, especially while tabs 18 are being bent.

Floor panels 22 comprise generally square or rectangular plates adapted to be laid side-by-side. The under side of each panel 22 may carry a layer 112 of fiberglass or other material for sound deadening and thermal insulation. Each panel 22 is bounded by lips 110, which are received by and interlock with various cruciform grooves 86 to form a complete raised flooring system 10 throughout the affected area. If additional stability is desired for flooring system 10, screws 98 (typically with a sheet metal thread) may be inserted through openings 114 of floor panels 22 into openings 94. As shown in FIG. 1, installing floor panels 22 in this manner provides a flooring system of uniform height above existing floor F, as the cruciform groove 86 and quadrants 90A–D of each stand-off 18 is capable of supporting abutting corners 118 of as many as four floor panels 22. Consequently, those skilled in the art will recognize that each segment of cruciform groove 86 in the embodiment of FIG. 1 has width at least twice that of lip 110.

Figure 4:
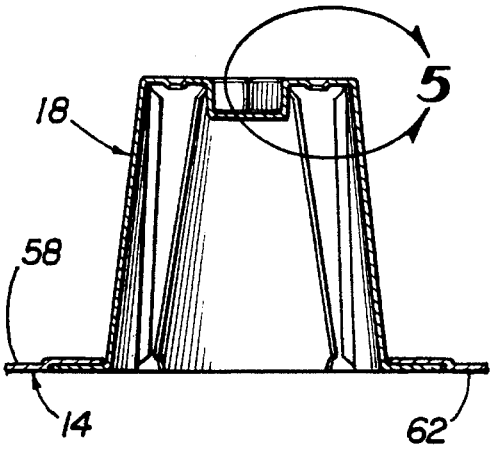
FIG. 4 is a cross-sectional view of the assembled base plate and stand-off taken along line 4—4 of FIG. 2.
Figure 5:
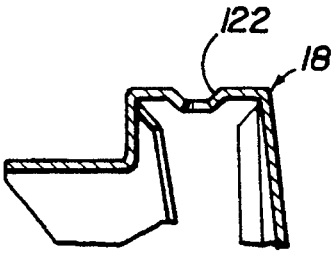
FIG. 5 is a cross-sectional view of a portion of the stand-off taken along curve 5 of FIG. 4.
Figure 5A:
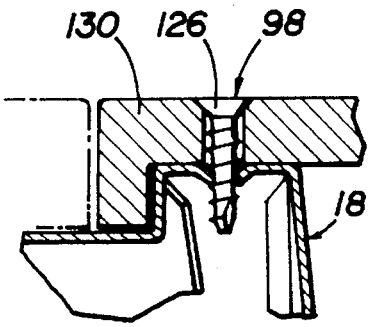
FIG. 5A is a cross-sectional view of the portion of the stand-off of FIG. 5 shown receiving a floor panel.
Figure 6:
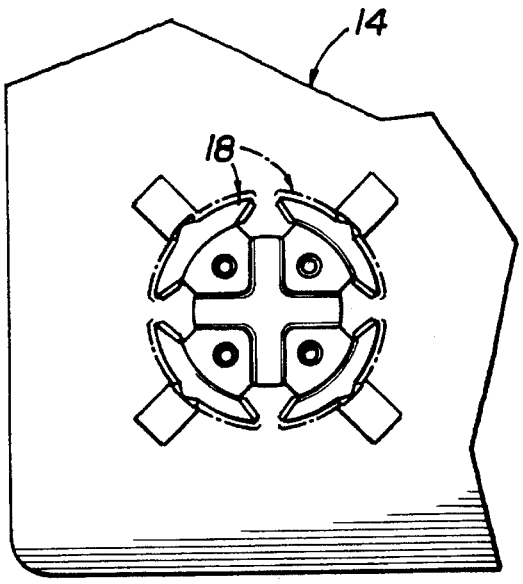
FIG. 6 is a plan view of the base plate and stand-off of FIG. 2 taken underneath the base plate.
Figure 8A:
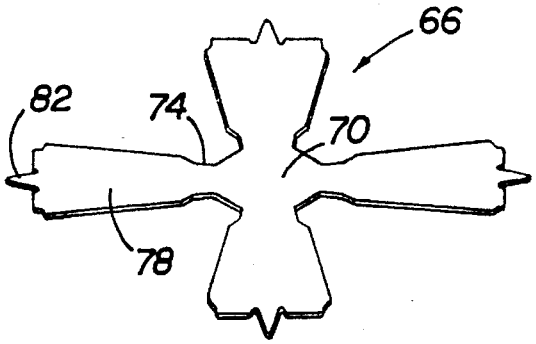
FIG. 8A–D are perspective views illustrating formation of the stand-off of FIG. 2.
Figure 8B:
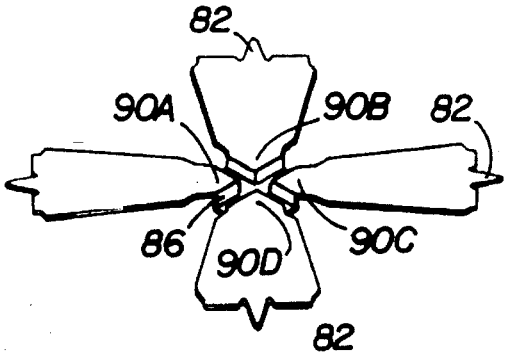

FIGS. 4, 5, and 5A illustrate countersink 122 circumscribing each opening 94 of stand-off 18. Countersinks 122 facilitate inserting screws 98 into openings 94 and help prevent screw heads 126 from protruding above the upper surfaces 130 of floor panels 22. Countersinks 122 additionally tend to permit openings 94 to constrict when screws 98 are tightened, enhancing the connection between floor panels 22 and stand-offs 18. As a result of this and other features of the present invention, flooring system 10 provides a non-combustible raised floor with substantial load-bearing strength. The foregoing is, however, provided for purposes of illustrating, explaining, and describing embodiments of the present invention. Modifications and adaptations to these embodiments will be apparent to those skilled in the art and may be made without departing from the scope or spirit of the invention.

What is claimed is:

1. A support structure comprising:

a. a base; and b. a non-combustible support comprising:

i. a spacer having a central section; and ii. a plurality of bendable arms depending from the central section, each of which arms has:

A. a first end connected to the central section; and

B. a second end disconnected from the second end of each other arm and terminating in bendable means for engaging the base when the support structure is in use.

2. A flooring system comprising:

a. a base defining four openings;

b. a stand-off comprising:

i. a central section defining a groove; and ii. four arms integrally formed with and depending from the central section, each arm defining means for insertion into a corresponding one of the four openings; and c. a panel comprising means for engaging the groove when the flooring system is in use.

3. The flooring system of claim 2 in which the base and stand-off are formed of sheet metal.

4. The flooring system of claim 3 which each arm comprises a plate that flares in width, between the central section and the insertion means.

5. The flooring system of claim 4 in which each arm has two generally upstanding edges and at least of one of the edges is rolled.

6. The flooring system of claim 2 in which the relative sizes of the openings and the insertion means result in a friction fit between the insertion means and each of the openings.

7. The flooring system of claim 2 in which (1) the base is a sheet of metal with a depression adjacent to each of the plurality of openings and (2) the insertion means is a tab that is inserted through one of the openings and bent to lie flat against the base within the depression adjacent to the one opening.

8. The flooring system of claim 2 further comprising means for electrically connecting adjacent bases.

9. The flooring system of claim 2 further comprising means for fixing the base to the floor.

10. The flooring system of claim 2 further comprising means for fixing the panel to the stand-off.

11. The flooring system of claim 2 further comprising means for facilitating sectioning the base.

12. The flooring system of claim 2 in which (1) the base and stand-off are formed of sheet metal, (2) each arm comprises a plate that flares in width between the central section and the insertion means, (3) each arm has two generally upstanding edges, with at least of one of the edges rolled, (4) the relative sizes of the openings and the insertion means result in a friction fit between the insertion means and each of the openings, (5) the base has a depression adjacent to each of the plurality of openings, and (6) the insertion means is a tab that is inserted through one of the openings and bent to lie flat against the base within the depression adjacent to the one opening.

13. The flooring system of claim 12 further comprising:

a. means for electrically connecting adjacent bases;

b. means for fixing the base to the floor;

c. means for fixing the panel to the stand-off; and d. means for facilitating sectioning the base.

14. A device for spacing a load-bearing panel from a base covering an existing floor, comprising:

a. a central section for supporting the load-bearing panel; and b. a plurality of arms depending from the central section, each arm:

i. having first and second ends, the first end connected to the central section and the second end disconnected from the second end of each other arm; and ii. having first and second edges intermediate the first and second ends, at least one of which first and second edges is rolled.

* * * * *